United States Patent [19]

Schrotz et al.

[11] 4,392,424

[45] Jul. 12, 1983

[54] BELT PRINTING MECHANISM HAVING IMPROVED CATCH MECHANISM FOR DETENTING POSITIONING WHEEL

[75] Inventors: Kurt Schrotz, Hirschhorn; Richard Schwöbel, Rothenberg, both of Fed. Rep. of Germany

[73] Assignee: Esselte Pendaflex Corporation, Garden City, N.Y.

[21] Appl. No.: 292,222

[22] Filed: Aug. 12, 1981

[30] Foreign Application Priority Data

Sep. 16, 1980 [DE] Fed. Rep. of Germany ..... 3034923

[51] Int. Cl.[3] ..... B41J 1/60

[52] U.S. Cl. ..... 101/111

[58] Field of Search ..... 101/111, 93, 14, 105; 400/146

[56] References Cited

U.S. PATENT DOCUMENTS 3,796,152 3/1974 Finke et al. ..... 101/111

4,176,600 12/1979 Sato ..... 101/111

FOREIGN PATENT DOCUMENTS 2742053 9/1977 Fed. Rep. of Germany ..... 101/111

2941327 4/1980 Fed. Rep. of Germany ..... 101/111

*Primary Examiner*—Edward M. Coven

*Attorney, Agent, or Firm*—Gerald J. Ferguson, Jr.; Joseph J. Baker

[57] ABSTRACT

This invention relates to a belt printing mechanism with parallel mounted endless type belts which carry on their exterior surface print types. These type belts extend around an adjustment wheel and a plurality of star wheels where the star wheels are rotatable about a shaft where each star wheel has four corners. A catch mechanism is held under tension against the star wheels and holds these in predetermined detent positions to prevent free rotation of the star wheels. When printing multi-character symbols, the selected print types of adjacent type belts must be brought into predetermined printing positions. In order to assure a clean print copy, care must be taken that the print types rest in the exact same line height. In order to accomplish this, the catch mechanism for each star wheel is provided with a spring tongue which touches at least two separated points of the perimeter of its associated star wheel between two adjacent corners thereof. The plane of each spring tongue with respect to the plane in which its associated star wheel rotates is an acute angle. When the type belts are adjusted, the catch mechanism generates pressures which are clearly recognizable by the operator and which simplify the procedure of bringing the print types into their predetermined printing positions.

5 Claims, 4 Drawing Figures

BELT PRINTING MECHANISM HAVING IMPROVED CATCH MECHANISM FOR DETENTING POSITIONING WHEEL

BACKGROUND AND SUMMARY OF THE INVENTION

The present invention relates to a belt printing mechanism comprising endless belts which are disposed parallel to each other and which on their outer surfaces carry print types and are each led round an adjusting wheel and a star wheel rotatable about a shaft, and a catch mechanism for preventing a free rotation of the star wheels which is held in positive engagement with the star wheels and holds the latter in predetermined detent positions.

Such a belt printing mechanism is already known. In the latter printing mechanism the individual type belts can be adjusted by rotating the particular associated adjusting wheel so that desired print types at the type belt outer surfaces come into a predetermined printing position. On rotation of the adjusting wheel the type belt is entrained by the adjusting wheel and the associated star wheel about which the type belt is also led also rotates about its axis. A printing type on the type belt is in the printing position when it is disposed on the peripheral surface of the star wheel remote from the adjusting wheel. For printing multi-digit characters print types of a plurality of adjacently disposed type belts must be brought into the printing position. On rotating of the adjusting wheels for obtaining the desired adjustment of the type belts it must be ensured that the printing position of the types to be printed must be reached as exactly as possible. Slightly different adjustments of the types to be printed will result in printing types producing imprints which do not all lie on the same line height. To facilitate the exact adjustment of the printing types in the printing position for the operator a catch mechanism is provided which prevents the star wheels from being able to rotate freely. Said catch mechanism is so constructed that it holds each star wheel in a predetermined position and permits rotation of the star wheels only after overcoming a certain force. With the four-cornered star wheels employed the catch mechanism acts positively on the peripheral surface portion of the star wheels which is opposite the peripheral surface portion on which the print types are disposed in the printing position. By rotating the adjusting wheels the operator can move the type belts and thus also the star wheels against the force exerted by the catch mechanism but he can feel that before each rotation of a star wheel through 90° a certain force must be overcome. These force peaks which can be felt by the operator on rotating an adjusting wheel facilitate the correct positioning of the print types to be printed.

In the known printing mechanism as catch mechanism for each star wheel a push member is provided which by means of a spring is held in engagement with a peripheral surface portion of the associated star wheel. On rotation of the star wheel a corner thereof pushes the push member back against the spring force which leads to a noticeable increase in the force necessary for rotating the star wheel. The already mentioned force peaks then occur whenever the push member is pushed back by a star wheel corner against the spring force. To obtain the spring force a rubber strip is disposed beneath the push member provided for the individual star wheels and said strip can yield when the push member is pushed back by a star wheel corner. The catch mechanism in the known belt printing mechanism consists of numerous individual parts which must be made with close tolerances. These numerous individual parts are not only expensive to manufacture but also require a relatively great amount of time for installment into the belt printing mechanism.

The objective of the present invention is to further develop the belt printing mechanism of the type outlined at the beginning so that with simple and cheap means an exact locating of the print types to be printed can be achieved.

According to the invention this objective is achieved in that the catch mechanism comprises for each star wheel a spring tongue which contacts the portion of the peripheral surface of the star wheel extending between two adjacent corners of the star wheel at at least two spaced-apart points and the plane of which forms an acute angle with the plane in which the star wheel rotates about its shaft.

The spring tongue used in the belt printing mechanism according to the invention for each star wheel fulfills simultaneously the function of holding the star wheel in a desired position and the function of producing the force peaks which can be felt by the operator on adjustment of the type belts. In this manner the use of different components for fulfilling these two functions is obviated.

Other objects, advantages and novel features of the present invention will be apparent from the following detailed description of the invention when considered in conjunction with the accompanying drawings.

DETAILED DESCRIPTION OF THE INVENTION

Figure 1:
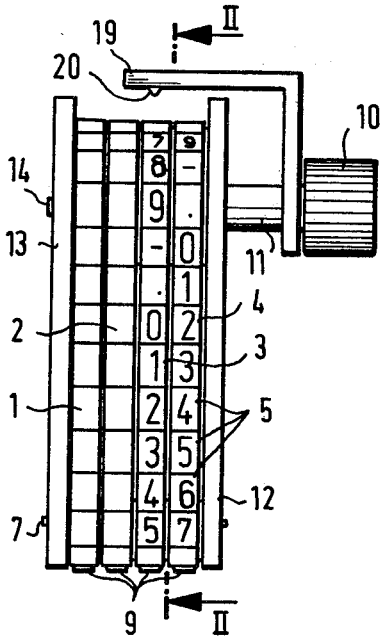
FIG. 1 is a view of a belt print mechanism having four type belts for printing four-digit characters.

The belt print mechanism illustrated in FIG. 1 includes four type belts 1, 2, 3 and 4 which are provided at their outer surface with print types 5. As apparent in the sectional view of FIG. 2 the type belts are endless belts or strips which are led about an adjusting wheel 6 and a star wheel 8 rotatable about a shaft 7.

Each type belt carries on its outer surface twelve print types 5; in the example of embodiment illustrated with these types the numbers 0 to 9, a full-stop and a hyphen can be printed. To enable a predetermined print type 5 to be used for printing it must assume the position of the print types 9 which according to FIGS. 1 and 2 lies beneath the respective associated star wheel 8. The desired print types can be brought into this position by displacing the type belts in their longitudinal direction by means of a special adjusting mechanism. Said adjusting mechanism includes a rotary knob 10 which is mounted non-rotatably on a hollow shaft 11. Said hollow shaft 11 is rotatably mounted in a side wall 12 of the belt printing mechanism and mounted displaceably in its longitudinal direction. Opposite the hollow shaft 11 a shaft 14 is fixedly connected to the other side wall 13 and projects into the interior of the hollow shaft 11 when it is displaced in its longitudinal direction.

Figure 2:
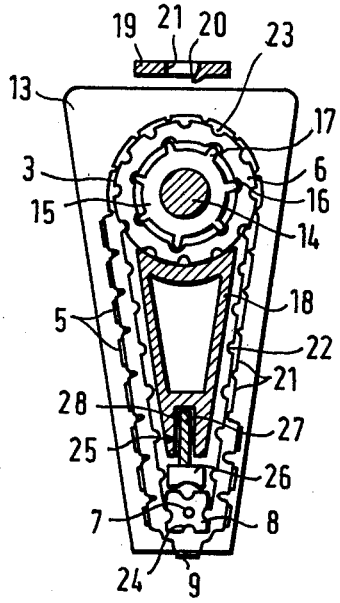
FIG. 2 is a section along the line II—II of FIG. 1.

The end of the hollow shaft 11 lying between the two side walls 12 and 13 carries a pinion 15 which can be seen in FIG. 2 and by axial displacement of the hollow shaft 11 can be brought into line with one of the adjusting wheels 6. As apparent from FIG. 2 the adjusting wheels 6 are rings whose inner surfaces are provided with grooves 16 into which teeth 17 on the pinion engage. The adjusting wheels 6 are mounted floatingly on a carrier body 18 connected fixedly to the side walls 12 and 13.

When the hollow shaft 11 is completely inserted, i.e. assumes the position lying furthest to the left in FIG. 1, the pinion 15 is aligned with the adjusting wheel 6 associated with the type belt 1. With the hollow shaft 11 completely withdrawn the pinion is however aligned with the adjusting wheel 6 of the type belt 4. In FIG. 1 the hollow shaft 11 is in an intermediate position in which the pinion 15 is in line with the adjusting wheel 6 of the type belt 3 so that by rotating the knob 10 said adjusting wheel 6 and thus the type belt 3 driven thereby can be displaced. This is also indicated by an indicating means 19 which is connected fixedly to the hollow shaft 11 and comprises a pointer 20 in line with the pinion 15 and coming to bear exactly above the type belt which can be moved by rotating the rotary knob 10. Disposed in the indicating means 19 is a window 21 through which the type belt which can be adjusted can be seen. To show exactly which print types are disposed in the position of the print types 9, on the outer surfaces of the type belts not only the twelve already mentioned print types are disposed but also a corresponding number of fields 21 each imprinted with a character corresponding to a print type. Said imprints are disposed in such a sequence that through the window 21 of the indicating means 19 the character which can be printed with the print type disposed in the position of the print type 9 is clearly apparent.

To obtain a good drive connection between the type belts 1 to 4 and the adjusting wheels 6, on the inner surface of each type belt projections 22 are disposed which engage in corresponding grooves 23 at the outer peripheral surface of each adjusting wheel. The star wheels 8 also comprise in each of their four straight peripheral surface portions a corresponding groove 24 into which the projections 22 of the type belts can engage.

If now to set a predetermined number to be imprinted in the position illustrated in FIG. 1 of the hollow shaft 11 the rotary knob 10 is turned the pinion 15 drives the adjusting wheel 6 so that the latter entraines the associated type belt 3. Because of the engagement between the grooves 24 on the star wheel 8 and the grooves 22 on the type ribbon 3 the star wheel 8 also rotates about the shaft 7. On continued rotation of the rotary knob 10 the print types successively come into the position of the print type 9 which the type must assume in order to obtain the desired imprint. For example in the setting of FIG. 6 the print type for the number 6 is in the position of the print type 9 so that after a corresponding inking with ink the number 6 is printed by the type belt 3. In the setting of FIG. 1 the type belt 4 also prints the number 8. For simplification of the illustration the types to be printed have not been indicated on the type belts 1 and 2.

To ensure that the numbers or characters to be printed by means of the type belts 1 to 4 lie exactly in a line the print types 5 disposed in the position of the print type 9 after carrying out the setting operation by means of the rotary knob 10 must assume on all type belts exactly the same location and be exactly horizontal in the illustration of FIG. 2. This position is only achieved if after completion of the setting operation the star wheel 8 assumes the position illustrated in FIG. 2 in which its peripheral surface portion remote from the adjusting wheel 6 is horizontal in the illustration of FIG. 2.

So that the operator carrying out the setting operation need not always observe the print types 5 located in the position of the print types 9, a catch mechanism 25 is provided which firstly prevents free rotation of the star wheels 8 about the shaft 7 and secondly ensures that the star wheels 8 are held in a detent position after a rotation through 90°. For this purpose the catch mechanism 25 comprises for each star wheel 8 a spring tongue 26 which is held in positive engagement with the peripheral surface portion of the star wheel 8 lying between two star wheel corners. The spring tongues are connected integrally to a base member 27 which sits in a groove 28 in the support body 18.

Figure 3:
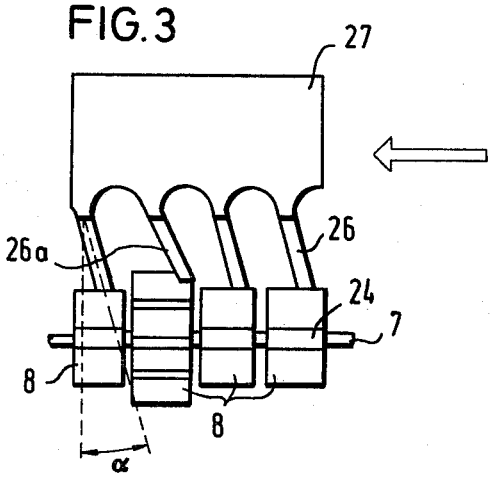
FIG. 3 is an enlarged illustration of the catch mechanism used in the ribbon printing mechanism of FIGS. 1 and 2 in cooperation with the star wheels and FIG. 4 is a side view of the catch mechanism in the direction of the arrow indicated in FIG. 3.
Figure 4:
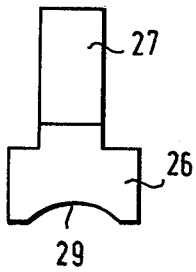

As apparent from FIG. 3 the planes of the spring tongues 26 are each inclined at an acute angle $\alpha$ to the plane about which the star wheels 8 can rotate about the shaft 7. This angle may be between 13° and 15°. The spring tongues resiliently engaging the adjacent peripheral surface portions of the star wheels 8 hold the latter in the position of FIG. 2 but because of their spring property they can yield to such an extent that a star wheel 8 can be rotated under the action of a driven type belt. FIG. 3 shows how a spring tongue **26*a* bends to a somewhat greater extent when the associated star wheel 8 is rotated by the type belt. The spring tongues 26 thus oppose the rotation of the star wheels 8 with different forces depending on whether the spring tongue engages a peripheral surface portion of the star wheel or is bent to a greater extent by a corner of the star wheel. For the operator adjusting the type belts by rotating the knob 10 the force peaks occurring when a star wheel corner acts on a spring tongue 26 can be clearly felt and the operator therefore knows that whenever a force peak has been overcome the star wheel just moved has assumed a definite location in which a print type 5 is exactly in the printing position of the print types 9. The force exerted by the spring tongues 26 on the star wheels 8 is high enough to rotate the respective star wheel 8 exactly into the position illustrated in FIG. 2 if the operator stops rotating the knob 10 before the star wheel 8** has reached said position.

The edges of the spring tongues 26 in contact with the star wheels are provided with an arcuate cutout 29 which runs parallel to the arc described by the corner of a star wheel 8 in its rotary movement. In this manner an excessive bending of the spring tongues 26 on rotating the star wheels 8 is avoided.

The spring tongues 26 may be made together with the base member 27 as a single component from thermoplastic plastic using the injection moulding method. The insertion of the catch mechanism 25 into the support body 18 also requires only one manipulation and this further reduces the assembly time of the entire belt printing mechanism.

With the printing mechanism described multi-digit characters may be printed in which the individual character locations lie exactly on the same line height. The catch mechanism 25 used to achieve this purpose can, because of its construction as described above, be made cheaply and inserted economically into the belt printing mechanism.

What we claim is:

1. In a belt printing mechanism having a plurality of parallel continuous type belts which on their exterior surface carry print types and which extend around an adjusting wheel and a plurality of respective star wheels where the star wheels are rotatable about a shaft and where each star wheel has four corners, and spring tongues for preventing free rotation of the star wheels which are held under tension against the star wheels to hold the latter in predetermined detent positions where the spring tongues touch at least two separated points of the perimeter located between two adjacent corners of the star wheels, the improvement wherein for each star wheel only one spring-tongue is provided whose plane with respect to the plane in which its associated star wheel rotates about the shaft is an acute angle.

2. Belt printing mechanism as claimed in claim 1, wherein the spring tongues are formed with the spacing of the star wheels on a joint base member.

3. Belt printing mechanism as claimed in claim 2 wherein the spring tongues and the base member consist of thermoplastic member.

4. Belt printing mechanism as claimed in claim 3 wherein the edges of the spring tongues contacting the star wheels have an arcuate cutout which extends parallel to an arc described by the corners of the star wheels on rotation about their shaft.

5. Belt printing mechanism as claimed in any one of the preceding claims wherein the angle between the plane of each spring tongue on engagement with a star wheel and the plane of rotation of the star wheel is about 13° to 15°.

* * * * *